United States Patent [19]

McLoughlin

[11] 4,304,051

[45] Dec. 8, 1981

[54] METHOD AND APPARATUS FOR DRYING PAPER-WOUND BUSHINGS

[75] Inventor: Joseph R. McLoughlin, Burnt Hills, N.Y.

[73] Assignee: General Electric Company, Schenectady, N.Y.

[21] Appl. No.: 144,322

[22] Filed: Apr. 28, 1980

[51] Int. Cl.[3] ..... F26B 3/20

[52] U.S. Cl. ..... 34/21; 34/92; 34/104; 165/104.21

[58] Field of Search ..... 165/105; 34/21, 104, 34/92; 99/419, 421 V

[56] References Cited

U.S. PATENT DOCUMENTS

| | | | |
|---|---|---|---|
| 2,539,943 | 1/1951 | Breazeale | 34/104 |
| 3,379,118 | 4/1968 | Perez | 99/419 |
| 3,627,899 | 12/1971 | Moore | 165/105 |
| 4,166,194 | 8/1979 | Bolin | 174/31 R |
| 4,168,393 | 9/1979 | Silva | 174/73 R |
| 4,194,296 | 3/1980 | Pagnozzi et al. | 34/92 |

*Primary Examiner*—Larry I. Schwartz

*Attorney, Agent, or Firm*—Charles E. Bruzga; James C. Davis, Jr.; Marvin Snyder

[57] ABSTRACT

In a method and apparatus for drying paper-wound bushings the paper-wound bushings are placed over a plurality of heat pipes which contain a vaporizable liquid as a heat transfer medium located within a closed container. The heat pipes are heated to raise the temperature of the paper-wound bushings to a level adequate to vaporize water left in said paper-wound bushings during manufacture thereof, thereby drying each of the bushings.

10 Claims, 5 Drawing Figures

METHOD AND APPARATUS FOR DRYING PAPER-WOUND BUSHINGS

BACKGROUND OF THE INVENTION

This invention relates to a method and apparatus for drying paper-wound bushings of the type used to bring high voltage into high voltage electrical equipment, such as transformers and switchgear.

Bushings for high voltage equipment comprise a hollow tubular conductor surrounded by a plurality of layers of paper forming an insulation wrap about the central conductor. In conventional bushings the wrapped paper is impregnated with degassed oil to enhance the dielectric properties of the bushing, and a ceramic sheath is disposed about the paper wraps before installation of the bushing in an actual electrical system. During manufacture of the bushings, the paper is wrapped about the conductor and saturated with water to facilitate tight wrapping of the paper. Following manufacture it is necessary to dry the bushings to remove essentially all the water from the wrapped paper, since water reduces the electrical breakdown strength of the insulation.

Prior art attempts to dry high voltage bushings have included placing the bushings in a heated, evacuated tank and holding them until the bushings have been heated to a temperature adequate to drive all the water from the paper wraps. This has required time periods as long as three weeks for large bushings. The tanks are conventionally heated by such means as steam, oil or direct resistance heat being applied to the inner wall of the tank, while the pressure in the tank is reduced to a vacuum condition. Since the air was removed from the tank, the predominant, and, in fact, nearly the only, transmitter of heat from the tank wall to the bushings was radiation. This heating technique is slow and subject to the disadvantage that the bushings disposed near the tank wall interfere with the radiational heating of the radially-inner bushings, further extending the process time required to adequately dry the bushings. The long time requirement for drying the bushings is the limiting factor on the rate of bushing manufacture using prior art drying techniques.

SUMMARY OF THE INVENTION

Therefore, an object of the instant invention is to provide a method and apparatus for rapidly drying paper-wound bushings. A more specific object of the instant invention is to provide a drying tank having a plurality of spaced heat pipes disposed therein, around which paper-wound bushings are placed during drying thereof, so that drying heat is applied to the central core of each of the bushings to be dried. In a particular embodiment of the instant invention, the heat pipes are evacuated and contain a liquid heat exchange medium which is heated to its vaporization temperature to transmit heat along the axial length of the heat pipes.

BRIEF DESCRIPTION OF THE DRAWINGS

The features of the invention believed to be novel and unobvious over the prior art are set forth with particularity in the appended claims. The invention itself, however, as to organization, method of operation and advantages thereof, may best be understood by reference to the following description taken in conjunction with the accompanying drawings in which:

DESCRIPTION OF THE PREFERRED EMBODIMENTS

Figure 1:
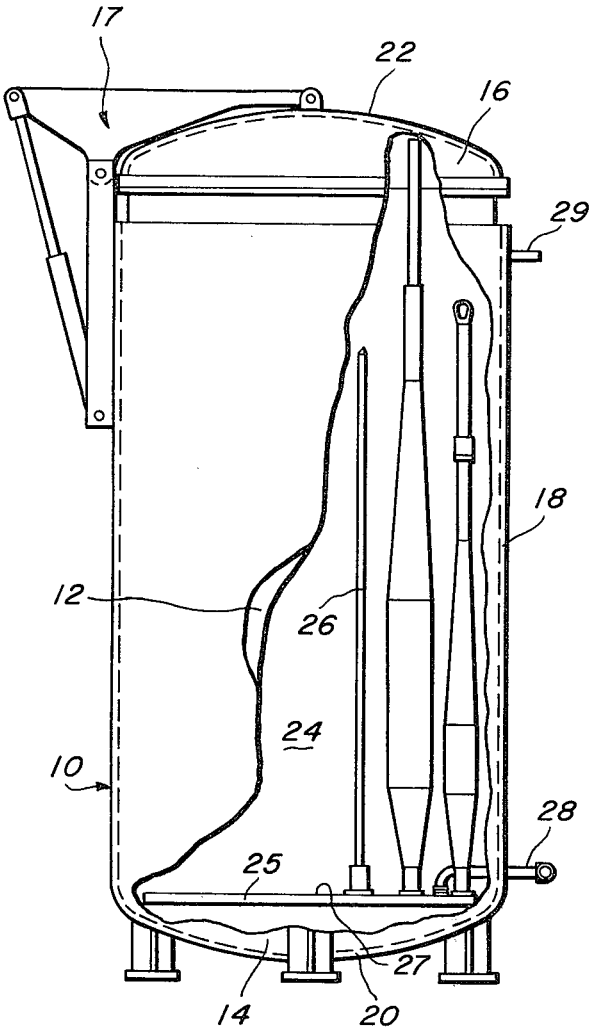
FIG. 1 is a schematic view with parts broken away of a drying tank built according to the instant invention for drying high voltage paper-wound bushings.

The specific manner and process for making and using the instant invention and the specific features thereof described herein and shown in FIGS. 1–5 are merely exemplary, and the scope of the invention is defined in the appended claims. Throughout the description and FIGS. 1–5, like reference characters refer to like or corresponding elements of the invention.

FIG. 1 shows a drying tank 10 for drying paper-wound bushings according to the instant invention. Tank 10 comprises an inner cylindrical wall 12, bottom end plate 14 and top end plate 16 with opening and closing mechanism 17. Wall 12 and end plates 14 and 16 are covered by insulating layers 18, 20 and 22, respectively, to reduce heat loss from the interior 24 of tank 10. A heat conductive platen 25 made of steel, copper, aluminum or other suitable heat conductive material is mounted within tank 10 and a plurality of heat pipes 26 are attached to platen 25 in generally uniformly-spaced arrangement about the surface 27 thereof. Heating means are provided to heat platen 25 to supply heat to each of the respective heat pipes 26. The heating means may be a steam heating supply introduced via inlet 28, an electrical resistance heating supply, a hot oil heat exchange arrangement or any other conventional heating means for applying heat to platen 25. Tank 10 also has outlet 29 for collection of water vapor removed from the paper-wound bushings.

Figure 2:
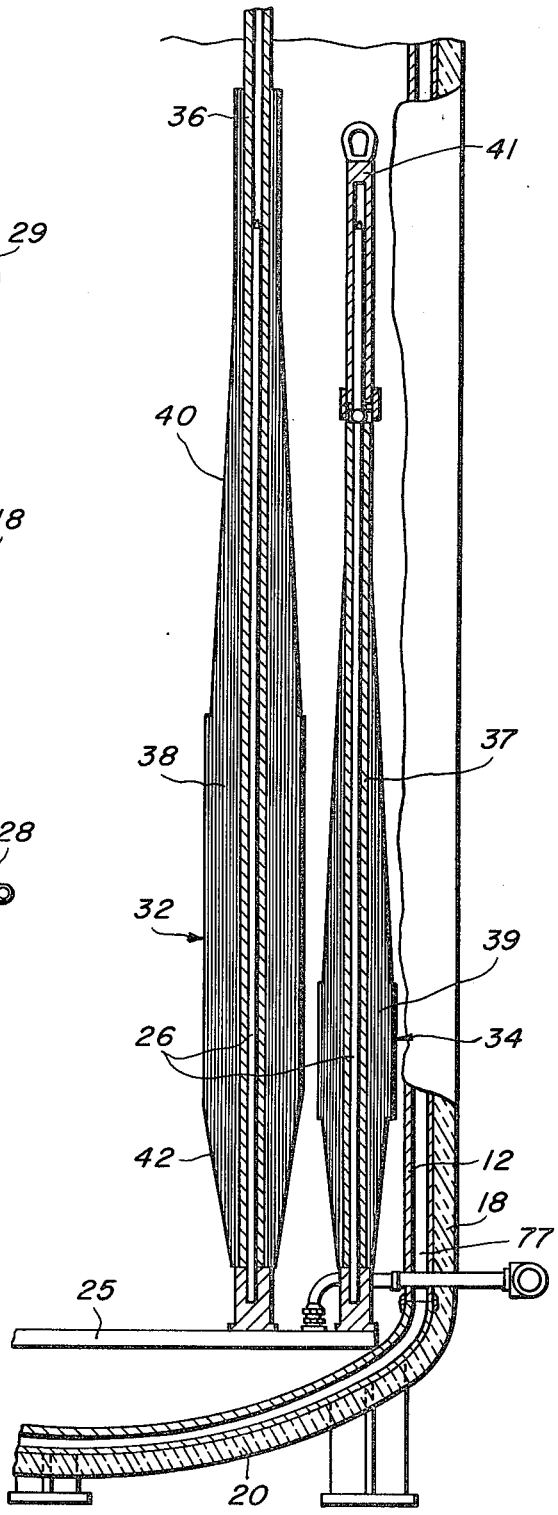
FIG. 2 is a schematic partial cross-sectional view showing the installation of heat pipes with paper-wound bushings thereon within a drying tank.

As shown in FIG. 2, bushings 32, 34 are disposed upon heat pipes 26 and spaced from each other and from the tank wall 12. Bushing 32 comprises hollow cylindrical conductor 36, usually of copper or aluminum, typically about 1.5–3.0 inches outside diameter and 0.2–0.5 inch thick, and a plurality of layers 38 of paper, such as 10 mil thick Kraft paper wrapped about conductor 36 and trimmed to form conically tapered ends 40, 42. Usually conductive foil shield layers of, for example, aluminum foil (not shown) are wound between the paper layers at selected radial positions. Bushing 34 has a construction similar to that of bushing 32, but hollow conductor 37 has a lesser axial length and the layers 39 of Kraft paper are of narrower width corresponding to the shorter length conductor 37. Bushings of a wide range of dimensions can be similarly accommodated by the drying tank arrangement of the instant invention, up to the maximum height of the interior 24 of tank 10 and to a practical minimum dictated by the availability of a hook, such as that shown at 41 in FIG. 2, to insert and remove the bushing.

Figure 3:
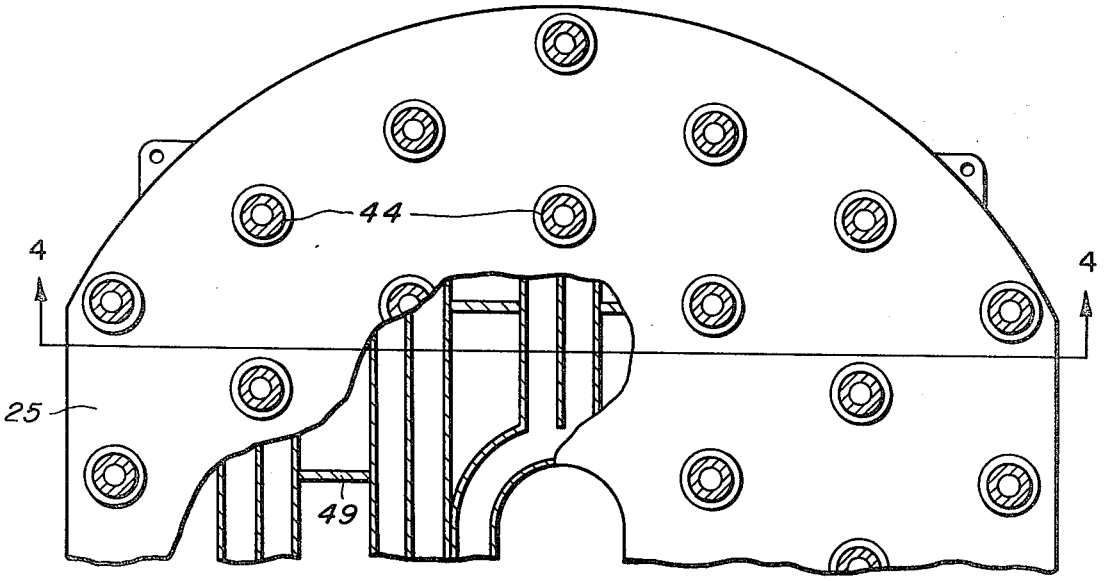
FIG. 3 is a schematic partial plan view of a heating platen and heat pipes according to the instant invention.
Figure 4:
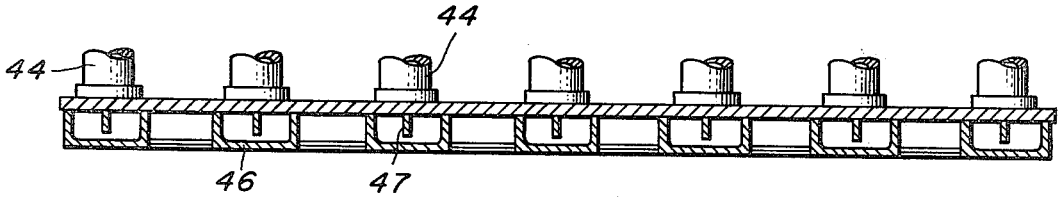
FIG. 4 is a schematic partial cross-sectional view taken along line 4—4 of FIG. 3.

As shown in FIGS. 3 and 4, platen 25 includes a plurality of mounting supports 44 for holding the respective heat pipes 26. Below platen 25 is a plurality of channels 46 in flow communication with inlet 28 through a manifold-type distribution system through which a hot fluid, such as steam or hot oil, may be circulated to supply heat to platen 25. Baffles 47 may be added to channels 46 to direct fluid flow therealong. Channels 46 are positioned by spacers 49 to be in alignment with heat pipe mounting supports 44 to maximize heat transfer from the heating fluid to the heat pipes 26. Alternatively, electrical resistance heating means may be disposed in contact with platen 25 to supply heat thereto.

Figure 5:
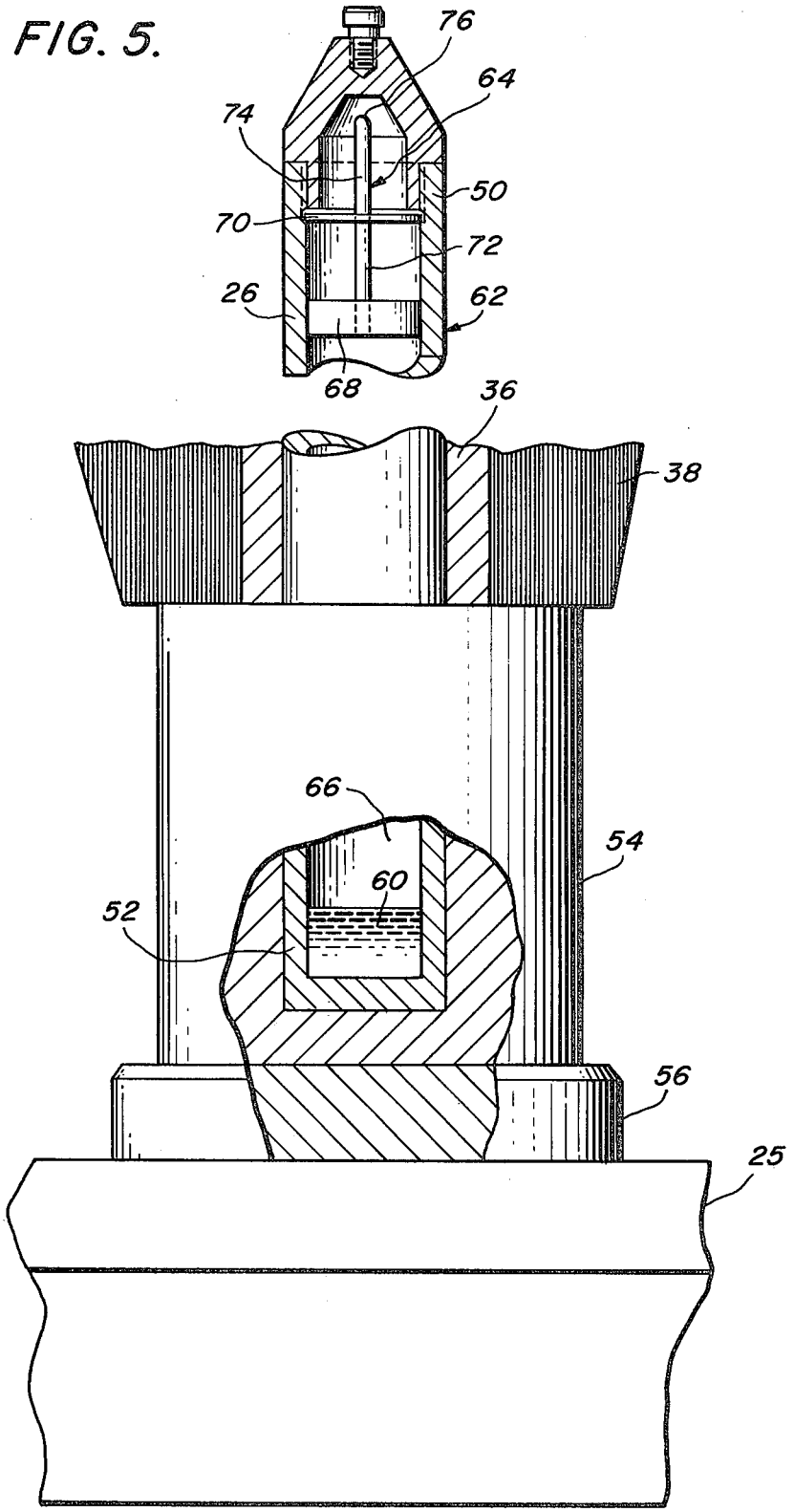
FIG. 5 is a schematic partial cross-sectional view with sections broken away of a particular heat pipe construction for use in the instant invention.

The upper and lower ends 50, 52 of one of the heat pipes 26 is shown in FIG. 5. Support 44 includes a collar 54 mounted upon base plate 56 and attached to platen 25. Heat pipe 26 is disposed within collar 54 and attached thereto, so that collar 54 aids in heat transfer from platen 25 to heat pipe 26. Heat pipe 26 comprises an elongated, cylindrical, tube 62 of brass or other suitable metallic material mounted within collar 54 at one end 52 thereof and having a heat pipe seal 64 disposed on the other end 50 thereof. The heat pipe seal 64 comprises a pair of flanges 68, 70 (e.g. of brass) connected by a hollow tube 72 of brass or other metallic material and a tube 74 of copper or other material suitable for sealing the heat pipe as described below attached to tube 72. At the time of assembly air is pumped out of the interior 66 of each of the heat pipes 26 to produce an evacuated chamber, and a quantity of heat exchange liquid 60, which may be water, alcohol, a chlorofluorocarbon liquid of the type sold under the trademark Freon by E. I. duPont de Nemours & Co., Inc. or other appropriate heat exchange liquid is placed within each of the heat pipes 26. Following evacuation of heat pipe 26 the tip 76 is sealed, for example, by swaging, welding, brazing or other suitable sealing technique.

The bushing drying arrangement as described above operates as follows: the platen 25 is heated by steam or other heating source to the vaporization temperature of the heat exchange liquid 60 disposed within the heat pipes 26. Heat exchange liquid 60 vaporizes and as the vapor disperses with the evacuated heat pipe 26 it transfers heat all along the axial length of the heat pipe. The metallic cylindrical wall 62 of the heat pipe 26 readily transfers heat to the cylindrical metallic conductor 36 of the bushing which transfers the heat to the paper layers 38 wound thereabout. As the vapor within each heat pipe transfers heat thereto, it is condensed and falls to the bottom of the heat pipe to be reheated. In this way a constant generally uniform heat flow from the full axial length of the heat pipes is achieved producing generally uniform heating of each bushing. Since each heat pipe is heated to very nearly the same temperature as each other heat pipe, uniform drying of all the bushings in a given drying run is accomplished. When the temperature within the paper wrapped about conductor 36 reaches the vaporization temperature of water, the water is driven from the paper bushing into the space 24 surrounding the bushings within tank 10 and is drawn off by a vacuum device (not shown) through outlet 29 to be collected by a condenser and trap arrangement (not shown).

A generally horizontal arrangement of heat pipes disposed within a generally horizontal enclosure could be employed to dry bushings in a manner similar to that described herein for vertically disposed heat pipes. To facilitate return of condensed heat exchange liquid to the heat pipe support, the end of the heat pipes distal from said support would be elevated slightly from the horizontal.

Following drying, the bushings are impregnated with degassed oil to provide the desired dielectric properties for the bushing, and are provided with a ceramic housing to protect the bushing from water contamination and other damage. By applying the heat directly to the interior of each of the respective bushings being dried, each bushing is more rapidly heated than is possible with the prior art technique of heating the cylindrical outer wall, and, since no bushing interferes with the heating of another bushing, the heating rate of the bushings is relatively uniform throughout a set of bushings being heated during a given run. If desired the heat supplied by the heat pipes may be supplemented by heating the tank wall 12 by resistance, steam, or other suitable heat source (e.g., via passages 77, FIG. 2).

In a particular experiment designed to test the heating performance of the instant invention, two separate single bushing drying runs were performed; one employing the prior art technique of heating the tank wall only, and the second run employing the instant invention. In the first run, a bushings was disposed in a tank in which the tank wall was heated by electrical resistance heaters. In the second run, the bushing was disposed around a heat pipe installed in a platen heated by electrical resistance heaters in contact therewith. The heap pipe was a brass tube 46" long and 1½" in diameter with a wall thickness of 0.055". The heat pipe was evacuated and 30 milliliters of water were added as the heat exchange medium. The top plug 64 comprised a pair of brass plugs 68, 70 connected by a brass pipe 72 and having a soft copper tube 74 attached to the upper end thereof and sealed by swaging at tip 76. Measurements of temperature within the bushing were made during the two runs starting from saturation of the paper to 10% water by weight, to compare the temperature at specific locations within each of the bushings after predetermined times of heating had elapsed. The water driven off each of the bushings was trapped in a liquid nitrogen trap and measured to obtain a comparison of drying rates. In the first run a water content of 2% by weight remaining in the bushing was achieved at 138 hours; 1% was achieved at 240 hours; and 0.5% was achieved at 372 hours. In the second run, a water content of 2% was achieved at 89 hours; 1% at 135 hours; and 0.5% at 219 hours. The ratios of heat pipe time to control time (i.e., first run time) for the dryness states were 2% water content in 66% of the time required in the first run; 1% in 56% of the time required in the first run; and 0.5% in 59% of the time required in the first run. Thus, the savings in time to dry the bushings were approximately 40%. It is noted that in a multiple bushing drying arrangement the improvement in drying speed would be expected to exceed the single bushing result, since the drying rate in the inner bushings using the prior art technique would be slowed by the interference of the radially outer bushings with heat transfer from the tank wall to the inner bushings. The instant novel drying technique reduces the water content in the paper-wound bushings from a typical concentration of 10% by weight to a desired level of 0.1 to 0.5% by weight water in a fast, efficient manner. Those skilled in the art will recognize that other heating techniques, such as electrical resistance heating, of heating the interior of the bushings could be employed. Therefore, it will readily be understood by those skilled in the art that the instant invention provides a significant improvement in performance of apparatus for the drying of paper-wound bushings.

I claim:

1. Apparatus for drying paper-wound bushings having conductive foil layers at predetermined radial positions, comprising:

a closed insulated container;

a heat conductive platen disposed within said container;

a plurality of heat pipes attached to said platen; each of said heat pipes comprising an evacuated elongated hollow cylindrical pipe closed at each end thereof and containing a quantity of heat exchange liquid;

heating means for heating said platen to a temperature sufficient to vaporize said liquid; and means for collecting water vapor driven off bushings disposed around said heat pipes.

2. The apparatus of claim 1 wherein said heat pipes are disposed vertically within said container and are secured, respectively, to one of a plurality of mounting collars; said mounting collars being in heat exchange relationship with said platen and said respective heat pipes.

3. The apparatus of claim 2 wherein said heat pipes are thin walled tubes closed at the end distal from said collars by a pair of disc seals connected by a hollow tube; said tube being connected to a copper tube sealed at the end thereof distal from said disc seals.

4. The apparatus of claim 3 wherein said heat exchange liquid comprises water.

5. The apparatus of claim 3 wherein said heat exchange comprises a chlorofluorocarbon liquid.

6. The apparatus of claim 3 wherein said heat exchange liquid comprises alcohol.

7. The apparatus of claim 3 wherein said container comprises a heat conductive inner wall surrounded by a heat insulating outer wall; and heat supply means for heating said inner wall.

8. A method of drying paper-wound bushings having conductive foil layers at predetermined radial positions, comprising:

disposing each of a plurality of bushings concentrically about a respective one of a plurality of heat pipes disposed in an insulated enclosure;

evacuating said enclosure;

heating said heat pipes to vaporize a heat exchange liquid disposed therein; and removing from said enclosure water vaporized from said bushings.

9. The method of claim 8 wherein said step of heating said heat pipe comprises heating a platen upon which said plurality of vertically extending heat pipes is mounted.

10. The method of claim 9 further comprising heating an inner heat conductive wall of said enclosure disposed within an insulating outer wall of said enclosure.

* * * * *